US007834755B2

(12) United States Patent
Butalla, III et al.

(10) Patent No.: US 7,834,755 B2
(45) **Date of Patent: *Nov. 16, 2010**

(54) INTELLIGENT REMOTE TEST/DISPLAY UNIT FOR DUCT SMOKE DETECTOR

(75) Inventors: Fred M. Butalla, III, Joliet, IL (US); David P. Harter, Gilberts, IL (US)

(73) Assignee: Honeywell International Inc., Morristown, NJ (US)

( * ) Notice: Subject to any disclaimer, the term of this patent is extended or adjusted under 35 U.S.C. 154(b) by 95 days.

This patent is subject to a terminal disclaimer.

(21) Appl. No.: 11/316,159

(22) Filed: Dec. 21, 2005

(65) Prior Publication Data

US 2007/0139184 A1 Jun. 21, 2007

(51) Int. Cl.
*G08B 29/00* (2006.01)

(52) U.S. Cl. ..... 340/506; 340/522

(58) Field of Classification Search ..... 340/506, 340/522, 628, 632; 73/863.1–863.33
See application file for complete search history.

(56) References Cited

U.S. PATENT DOCUMENTS

| | | | | |
|---|---|---|---|---|
| 6,124,795 | A * | 9/2000 | Bernau et al. | 340/628 |
| 6,897,774 | B2 * | 5/2005 | Costa et al. | 340/522 |
| 2003/0234732 | A1 * | 12/2003 | Rhodes et al. | 340/870.16 |
| 2004/0257235 | A1 * | 12/2004 | Right et al. | 340/628 |
| 2005/0275527 | A1 * | 12/2005 | Kates | 340/539.22 |

OTHER PUBLICATIONS

Edwards Systems Technology, "Four-wire Duct Smoke Detector", SuperDuct Series, Issue 1, Literature Sheet #85001-0583, pp. 1-6, © 2004 Est.

Air Products and Controls Inc., "Duct Smoke Detectors", SL-2000 Series, DS-DU-1 E050224, pp. 1-2, © 2005.

Air Products and Controls Inc., "Duct Smoke Detectors", SM-501 Series, DS-DU-2 C050110, pp. 1-2, © 2005.

System Sensor, "Air Duct Smoke Detector", Model DH400ACDCIHT, Manual D400-64-00, I56-991-08R, pp. 1-12, © 2003.

System Sensor, "4-Wire Low-Flow Duct Smoke Detector", Model DH100ACDCLP, Brochure A05-1044-005, Jan. 2004, #1226, pp. 1-4, © 2004.

System Sensor, "Air Duct Smoke Detector with Extended Air Speed Range", Model DH100ACDCLP, Manual D200-14-00, I56-0084-08R, pp. 1-8, © 2003.

Siemens Building Technologies, "Intelligent Photoelectric Detectors for IXL, MXL, and XL3 Control Panels", ILP Series, ILP-1, ILPT-1, Catalog No. 6164, pp. 1-4, Jul. 2001.

Siemens Building Technologies, "Ionization Smoke Detector", DI-3, DI-A3 and DI-B3, Catalog No. 6119, pp. 1-4, Oct. 2002.

Siemens Building Technologies, "Air Duct Housings", Series IL, and Series 3 Ionization or Photoelectric Detectors, Catalog No. 6124, pp. 1-6, May 2003.

(Continued)

*Primary Examiner*—Shirley Lu
(74) *Attorney, Agent, or Firm*—Husch Blackwell LLP Welsh Katz

(57) ABSTRACT

A remote accessory unit can communicate via a data protocol with one or more displaced duct detector control units. The accessory unit can present status indicators visually, on a per sensor basis. Both audible and visible annunciators can be provided to indicate an alarm condition.

18 Claims, 2 Drawing Sheets

OTHER PUBLICATIONS

Siemens Building Technologies, "Intelligent Fire Detectors for MXL, MXL-IQ and MXLV Control Panels", FP-11 FirePrint™ Detector, Catalog No. 6175, pp. 1-4, Jun. 2003.

Simplex Time Recorder Co., "Waterproof Duct Housing Enclosure 4098-9845", TrueAlarm® Analog Sensing, Brochure S4098-0032-2, pp. 1-4, Apr. 2001.

Simplex Time Recorder Co., "Duct Detector Housings with TrueAlarm Photoelectric Detector for 2-Wire or 4-Wire Operation", TrueAlarm® Smoke Detectors, Brochure S4098-0029-4, pp. 1-4, Oct. 2003, © 2003 Tyco Safety Products Westminster.

Faraday 8710 Photo Dectector Product Description, available at http://www.totalcomputing.net/index.asp?. PageAction=VIEWPROD&ProdID=43, published at least one year before Dec. 21, 2005.

* cited by examiner

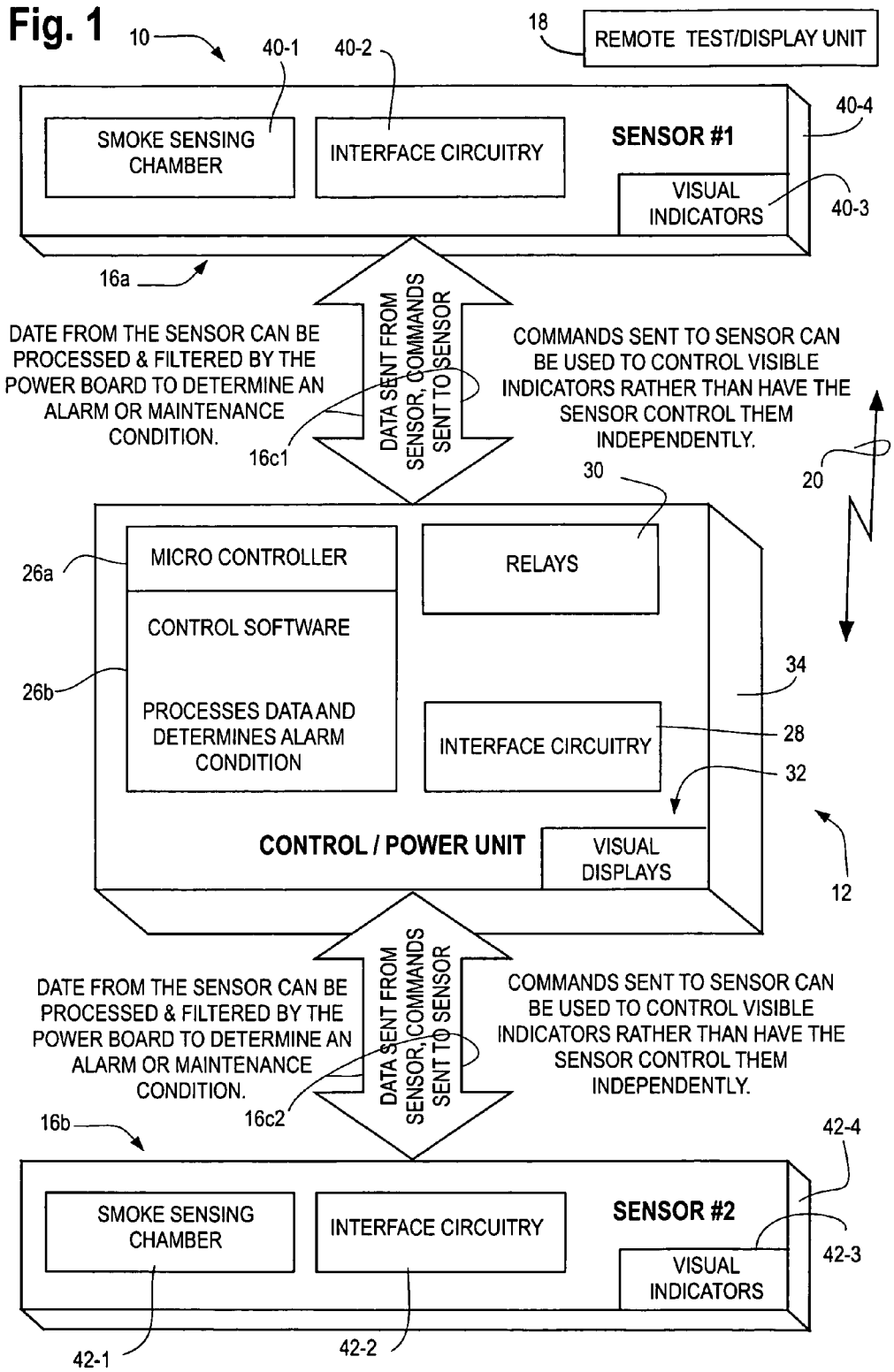
Fig. 1
10
40-1
40-2
18
REMOTE TEST/DISPLAY UNIT
SMOKE SENSING CHAMBER
INTERFACE CIRCUITRY
SENSOR #1
40-4
VISUAL INDICATORS
40-3
16a
DATE FROM THE SENSOR CAN BE PROCESSED & FILTERED BY THE POWER BOARD TO DETERMINE AN ALARM OR MAINTENANCE CONDITION.
DATA SENT FROM SENSOR, COMMANDS SENT TO SENSOR
COMMANDS SENT TO SENSOR CAN BE USED TO CONTROL VISIBLE INDICATORS RATHER THAN HAVE THE SENSOR CONTROL THEM INDEPENDENTLY.
16c1
30
20
26a
MICRO CONTROLLER
RELAYS
CONTROL SOFTWARE
26b
PROCESSES DATA AND DETERMINES ALARM CONDITION
34
INTERFACE CIRCUITRY
28
32
CONTROL / POWER UNIT
VISUAL DISPLAYS
12
DATE FROM THE SENSOR CAN BE PROCESSED & FILTERED BY THE POWER BOARD TO DETERMINE AN ALARM OR MAINTENANCE CONDITION.
DATA SENT FROM SENSOR, COMMANDS SENT TO SENSOR
COMMANDS SENT TO SENSOR CAN BE USED TO CONTROL VISIBLE INDICATORS RATHER THAN HAVE THE SENSOR CONTROL THEM INDEPENDENTLY.
16c2
16b
42-4
SMOKE SENSING CHAMBER
INTERFACE CIRCUITRY
SENSOR #2
VISUAL INDICATORS
42-3
42-1
42-2

INTELLIGENT REMOTE TEST/DISPLAY UNIT FOR DUCT SMOKE DETECTOR

FIELD

The invention pertains to ambient condition detectors which can be coupled to various types of heating and/or air conditioning ducts. More particularly, the invention pertains to duct detectors which incorporate one or more programmable processors to provide predetermined functions as well as displaced test/display units.

BACKGROUND

One duct detector structure has been disclosed in U.S. Pat. No. 6,124,795 entitled "Detector Interconnect System", issued Sep. 26, 2000. The '795 patent is assigned to the Assignee hereof and is incorporated herein by reference.

Many of the known duct smoke detectors incorporate a smoke sensor and a power supply board which incorporates power supply circuitry and alarm indicating relays. In such smoke detectors, the smoke sensor unit makes an alarm determination. The circuitry on the power board then receives a signal from the smoke sensor indicating an alarm condition and responds thereto by activating local alarm indicating relays, and/or light emitting diodes to indicate an alarm condition. Such power boards are unable to make decisions based on multiple detected conditions where the unit incorporates more than one smoke sensor. Further, such power boards are unable to signal the condition of the respective sensors to a displaced display/input unit in the absence of extra conductors.

Remote test accessories or devices have been used with duct smoke detectors. Such devices can be mounted on a wall or ceiling and connect to a respective one or more duct smoke detector(s). Such detector(s) might be mounted in an inconvenient location such as in the ceiling of the respective building, or floor of a multi-floor structure. Such devices provide convenient access to an indicator of status of the respective sensor. They can also be used to test and/or reset the respective detector structure.

Known test accessories are usually connected to the respective detector's relay(s) to obtain status signals. Known accessories have been limited to providing status information for only a single sensor. Such accessories often require numerous wires to transfer signals back and forth to/from the respective duct detector.

There continues to be a need for test/display devices or accessories that provide a greater degree of functionality to users than is currently available. It would be desirable to reduce the number of wires needed for communications between the respective duct detector assembly and the respective test/display unit. It would also be desirable to be able to separately test each of several different sensors of the duct detector assembly. It would also be desirable to provide such additional functionality without substantially increasing the manufacturing cost or complexity of such accessories.

BRIEF DESCRIPTION OF THE DRAWINGS

FIG. 1 is an overall block diagram in accordance with the invention; and

DETAILED DESCRIPTION

Figure 2:
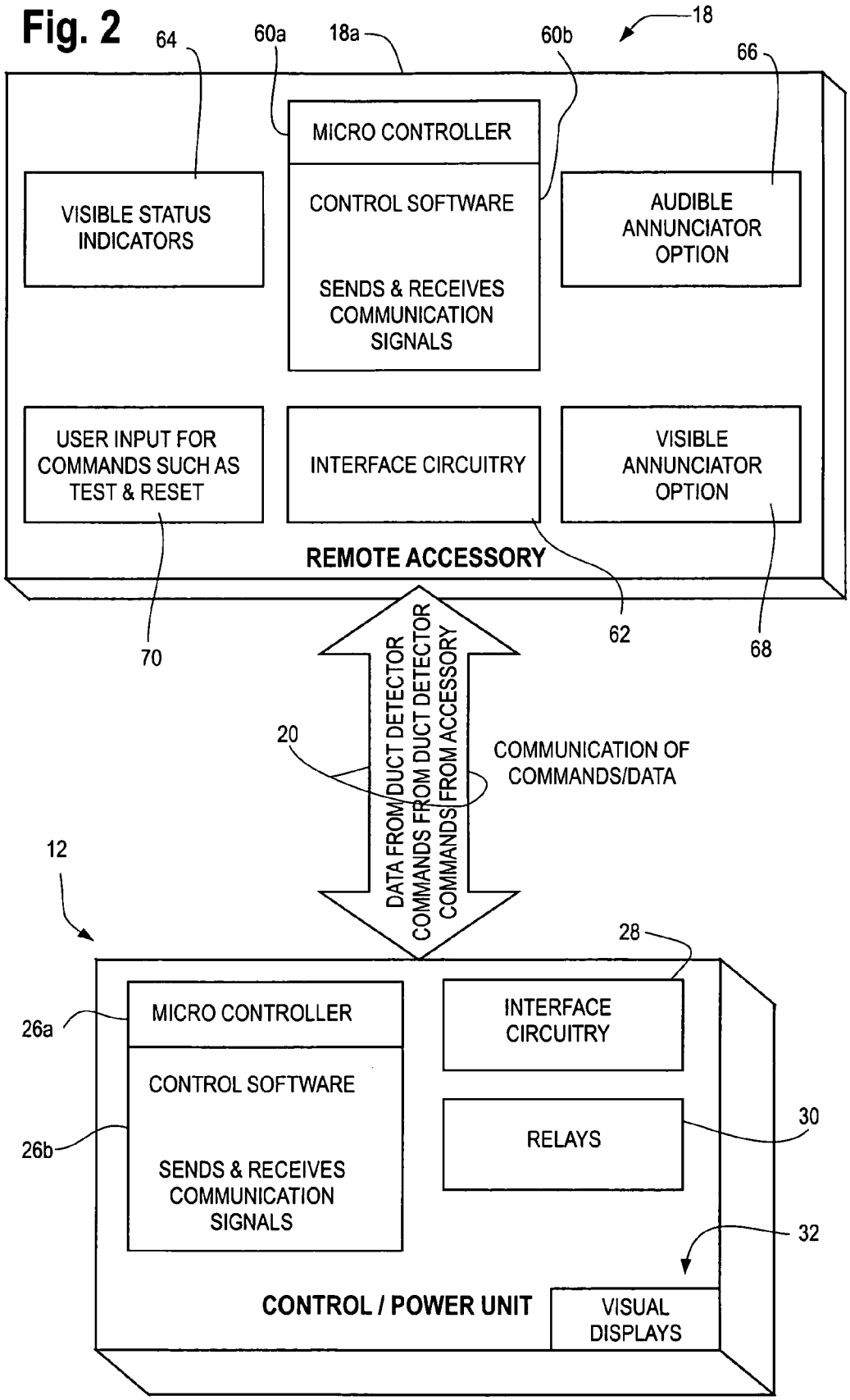
FIG. 2 is a block diagram illustrating various aspects of a remote test/display unit in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

A duct detector can incorporate one or more ambient condition sensors or detectors, a programmable control processor along with a control program or a state machine. A plurality of relays and visual alarm indicating devices can also be provided.

The programmable processor, in combination with the control software or a state machine, can receive signals from one or more ambient condition sensors coupled thereto. The processor and control software can process and filter the signals and make an alarm determination relative to each of the ambient condition sensors of the unit. Types of sensors include smoke sensors, gas sensors and the like all without limitation.

The programmable processor and associated control program or a state machine can evaluate the condition of one or more ambient condition sensors and determine, for example, sensitivity of the respective device as well as any other parameters of interest. In that regard, the programmable processor or state machine can adjust alarm thresholds, filter signals received from the respective sensors as well as carryout alarm condition processing using inputs from one or more of the associated sensors. Further, in conjunction with a remote test/display unit, the programmable processor or state machine and associated control circuitry can provide information as to condition and alarm state on a per sensor basis. Additionally, the programmable processor or state machine and associated control circuitry can provide control signals to one or more local alarm indicating visual output devices such as light emitting diodes.

The programmable processor and associated control program or a state machine can assign different priorities to the various sensors. Priorities could be used to make decisions as to driving common alarm indicating relays without affecting the state of visible status indicators associated with each sensor. Trouble conditions can also be determined on a per sensor basis.

The present programmable processor and associated control program or a state machine can communicate with displaced sensors. In this embodiment, one sensor could be located for example in the supply air side of an air handling unit. The other could be located in the return air side of an air handling unit. In other configurations, the multiple sensors could be incorporated into a common housing with the programmable processor and associated control software or the state machine.

In accordance with the invention, a remote test/display unit or accessory can incorporate a digital or analog communication protocol to communicate with a control/power unit of a duct smoke detector. In this regard, the accessory can test and evaluate the operational condition of multiple sensors by communicating to the duct smoke detector control unit commands or information as to which of the sensors is to be tested. Multiple sensors can be in different states. In accordance with the invention, the status of each respective sensor can be provided. For example, the status of each such sensor can be separately displayed. Further, information on a per sensor basis, such as a sensitivity measurement, can also be provided.

The test accessory can incorporate a programmable processor as well as associated control circuitry. A variety of digital or analog communications protocols can be used to communicate between the remote test accessory and the respective control/power unit of the smoke detector(s).

Further in accordance with another aspect of the invention, the remote test accessory can provide visual and/or audible status indicators for each of the respective sensors. Alarm or trouble conditions, on a per sensor basis, can also be indicated both visually and audibly. In yet another aspect of the invention, user inputs can be provided for test and reset purposes. Test and reset commands could be sent via a communication link to the control/power unit for the duct smoke detector. The respective command can require that the one or more specified sensors be tested and evaluated. A response can be provided by the control/power unit to the remote accessory unit.

In yet another aspect of the invention, sensitivity measurements or other parameter information can be coupled to the remote accessory unit. Hence, it will no longer be necessary to be local to the respective control/power unit or associated sensors. Feedback can be provided to the remote test/display unit on a per sensor basis as to whether or not the respective sensor is in a standby condition, indicating a need for maintenance or whether the sensor is indicating a trouble condition.

Further, the use of a digital or analog communication protocol, whether wired or wireless, alleviates any need for multiple wires for various indicators, conditions or relays. Where a wired communication link is used, the remote accessory can communicate, relative to multiple sensors, with only power wires and a bi-directional communication signal wire. Communication can also be accomplished using power wires, one input communication signal wire, and one output communication signal wire.

FIG. 1 illustrates system 10. The system 10 includes a control/power unit 12 which is in wired or wireless communication with a plurality of sensors such as sensor 16*a* and sensor 16*b*. It will be understood that the type of sensor is not a limitation of the invention. Sensors 16*a,b* could include smoke sensors of various types, as well as gas sensors all without limitation. Further, one or more of the sensors such as 16*a,b* could be coupled to the control and power unit 12.

The system 10 can also incorporate a remote test/display unit 18. The unit 18 can be in wired or wireless communication with the control/power unit 12 via medium 20.

Each of the sensors 16*a*, 16*b* can also be in wired or wireless communication with the control/power unit 12 via medium 16*c*1-*c*2. Communications can be implemented via a binary or analog transmission protocol.

Control/power unit 12 can include control circuitry implemented as a programmable processor 26*a* and associated control software 26*b* or a state machine. The control hardware and software 26*a,b* or state machine can be coupled via interface circuitry 28 to local condition indicating relays 30, as well as to the various sensors 16*a,b* and remote accessory unit 18. If desired, local visual displays 32 could also be coupled to interface circuitry 28. The unit 12 can be incorporated into a closed housing 34 if desired.

Unit 12, as noted above, via medium 16*c*1,*c*2 is in bidirectional communication with respective sensors indicated at 16*a*, 16*b*. The sensors can be the same or different without departing from the scope and spirit of the present invention. In FIG. 1, sensor 16*a*, incorporates a sensing chamber which could be a smoke sensing chamber 40-1 which is in turn coupled to interface and control circuitry as appropriate 40-2. The circuitry 40-2 is in bi-directional communication via medium 16*c*1 with the unit 12. Sensor 16*a* can incorporate visual output devices 40-3 and be carried in a housing 40-4.

The sensor 16*b* can also incorporate an ambient sensing chamber, such as a smoke sensing chamber 42-1 which is in turn coupled to control and interface circuitry 42-2. The sensor 16*b* is in bi-directional communication via control interface circuitry 42-2 and medium 16*c*2 with unit 12. Sensor 16*b* can also incorporate visual output devices such as the light emitting diodes 42-3. The sensor 16*b* can also be carried by or within a housing 42-4.

The programmable control unit 26*a* and associated control software 26*b* or a state machine of unit 12 can communicate with the sensors such as sensors 16*a,b* by sending one or more commands over the respective medium 16*c*1, 16*c*2. Commands can be used for example to control visual output devices such as 40-3, 42-3 as well as to query the respective sensors such as 16*a,b* for data.

Data could also be provided by the respective sensor on a predetermined basis to the unit 12. The unit 12 can filter incoming sensor signals in hardware or software. Various processes could be executed in determining the existence of an alarm, maintenance or trouble condition. The unit 12 can initiate an alarm condition based on an analysis of data received from the respective sensor, and can activate the relays 30 in accordance therewith as well as visual output devices such 32, 40-3 as well as 42-2. Further, the unit 12 can notify the remote accessory 18 via medium 20 as to the existence of a determined alarm state. The unit 12 can also indicate a trouble condition or the need for maintenance as would be understood by those of skill in the art.

The remote test/display unit 18 can send one or more test commands to the control/power unit 12. The unit 12 will in turn evaluate the condition of the respective sensors and communicate with the remote accessory 18 accordingly. Sensor status includes, standby, alarm, maintenance or trouble. The unit 12 can also take other actions as a response to the test commands from the remote test/display unit 18.

The unit 12 in communicating with accessory 18 via medium 20 can utilize a predetermined communications protocol for the transfer of information therebetween. Where the medium 20 is a wired medium, the use of a communication scheme results in needing fewer wires between the unit 12 and the remote accessory 18 to communicate the desired information. The communications protocol between units 12 and 18 is not a limitation of the present invention.

A variety of protocols as would be understood by those of skill in the art for transmitting digital or analog data between the units 12 and 18 could be used without departing from the spirit and scope of the present invention. In summary, the unit 12 can communicate the status of multiple sensors, whether they are in a standby condition, alarm condition, maintenance or trouble condition independently of the state or states any other sensor such as 16*a* or 16*b* is exhibiting.

FIG. 2 illustrates additional details of the remote test/display unit 18 in accordance with the invention. The unit 18 can be incorporated into a closed housing 18*a*.

Control circuitry can include a programmable processor or controller 60*a* and associated control software 60*b* or a state machine. The processor 60*a* can be coupled to interface circuitry 62 for carrying out digital or analog communications via medium 20, wired or wirelessly, with one or more control/power units 12.

The accessory unit 18 can also incorporate a plurality of visual status indicators 64, one or more audible indicators or enunciators 66, as well as one or more visual enunciators out 68. One or more user inputs 70 can be provided for directing a test or reset commands, or any other commands, to the control/power unit 12.

Remote accessory unit 18 can communicate commands to the control unit 12, via medium 20. It can also receive information or data from unit 12 pertaining to one or more sensors and can also receive commands therefrom all without limitation. The status indicators 64 can indicate, on a per sensor basis, a standby state, an alarm state, a maintenance needed state and/or a trouble state.

In summary, unit 18 can transmit commands to and receive data from control element 12 using a predetermined binary transmission protocol. As a result, only a limited number of conductors is needed, where a wired medium couples the unit 18 and the element 12 together, irrespective of the number of commands and nature or extent of the data.

It will be understood that element 12, unit 18 as well as any associated sensors can be implemented using a variety of technologies without departing from the spirit and scope of the invention. Programmable processors and associated software can be used, field programmable gate arrays can be used as well as hardwired logic as appropriate.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A system comprising:

a duct detector;

first and second ambient condition sensors incorporated into the duct detector;

a visual status indicator associated with each of the first and second ambient condition sensors;

a displaced control unit, said control unit having separate first, second, and third communication mediums, the first and second communication mediums used for independently communicating with the respective first and second ambient condition sensors;

control circuitry of the displaced control unit that assigns a priority to each of the first and second ambient condition detectors, queries the respective ambient condition sensors for sensor data, initiates an alarm condition based upon analysis of data received from at least one of the respective first and second ambient condition sensors and controls the visible status indicator on the at least one of the first and second ambient condition sensors to indicate an alarm condition rather than having the at least one of the first and second ambient condition sensors control the visual status indicator independently;

an alarm indicating relay of the displaced control unit associated with the control circuitry where the assigned priorities are used to activate the at least one relay without effecting a state of the visible status indicator on each of the at least two duct sensors;

a remote display device, the remote display device including a display for visually presenting status of the respective first and second ambient condition sensors coupled to the displaced control unit, the remote display device communicating with the displaced control unit via the third communication medium; and a manually operable duct sensor command input element associated with the remote display device for receiving user inputs;

wherein the first and second ambient condition sensors are coupled directly to the displaced control unit and communicate with the displaced control unit via the respective first and second communication mediums on a per sensor basis, and wherein the remote display device is remotely located from the displaced control unit and sensors, the remote display device sends and receives communications via the third communication medium on a per sensor basis.

2. A system as in claim 1 where the interface circuitry includes circuitry that receives data via at least one of a wired or wireless medium.

3. A system as in claim 2 where the circuits include software which receives duct sensor data from the communications interface.

4. A system as in claim 2 where the circuit includes a state machine which receives duct sensor data from the communications interface.

5. A system as in claim 1 that includes circuitry for measuring and transmitting the sensitivity information of multiple sensors.

6. A system as in claim 1 where the remote display device includes an audible enunciator.

7. A system as in claim 1 where the remote display device includes a visible enunciator.

8. A system comprising:

a duct detector;

at least two ambient condition detectors incorporated into the duct detector;

a visual status indicator associated with each of the at least two ambient condition detectors;

a displaced control unit directly coupled to the at least two ambient condition detectors;

control circuitry of the displaced control unit that assigns a priority to each of the at least two ambient condition detectors, that queries the respective at least two ambient condition detectors for sensor data, initiates an alarm condition based upon analysis of data received from at least one of the at least two ambient condition detectors, and controls the visible status indicator on the at least one of the at least two ambient condition detectors to indicate an alarm condition rather than the at least one of the at least two ambient condition detectors controlling the visual status indicator independently;

an alarm indicating relay of the displaced control unit activated by the control circuitry where the assigned priorities are used to activate the at least one relay without effecting a state of the visible status indicator on each of the at least two ambient condition detectors;

a remote display unit, the remote display unit including a display for visually presenting status of the respective at least two ambient condition detectors coupled to the displaced control unit, the display is located on the remote display unit;

a communications interface carried by the remote display unit for remotely communicating with the displaced control unit on a per ambient condition detector basis; and control circuits carried by the remote display unit and coupled to the communications interface;

wherein the remote display unit includes at least one manually operable duct sensor command input element for receiving a test or reset command for one of the at least two ambient condition detectors, wherein the at least two ambient condition detectors communicate with the displaced control unit on a per ambient condition detector basis, wherein the remote display unit is remotely located from the displaced control unit and at least two ambient condition detectors, and wherein the received test or reset command is transmitted to the one of the at least two ambient condition detectors.

9. A system as in claim 8 where the remote display unit includes a plurality of manually operable duct detector command input elements.

10. A system as in claim 8 where the interface circuitry includes circuitry that transmits and receives data via at least one of a wired or wireless medium.

11. A system as in claim 10 where binary or analog data is transmitted to the displaced control unit by the circuitry that transmits and receives.

12. A system as in claim 11 where at least some of the binary or analog data comprises duct sensor commands.

13. A system as in claim 12 where at least one input element specifies a sensor to which a command is directed.

14. A system as in claim 13 where binary or analog data is received from the displaced control unit by the circuitry that transmits and receives.

15. A system as in claim 14 where the control circuits include control software which couples duct detector commands to the communications interface.

16. A system as in claim 14 where the control circuits include a state machine which couples duct detector commands to the communications interface.

17. A system as in claim 14 where the control circuits include control software which receives duct detector feedback from the communications interface.

18. A system as in claim 14 where the control circuits include a state machine which receives duct detector feedback from the communications interface.

* * * * *